US005439105A

United States Patent [19]

Focke

[11] Patent Number: 5,439,105

[45] Date of Patent: Aug. 8, 1995

[54] HINGE-LID PACK

[75] Inventor: Heinz Focke, Verden, Germany

[73] Assignee: Focke & Co. (GmbH & Co.), Verden, Germany

[21] Appl. No.: 220,879

[22] Filed: Mar. 31, 1994

[30] Foreign Application Priority Data

Apr. 2, 1993 [DE] Germany ..... 43 10 769.9

[51] Int. Cl.[6] ..... B65D 85/10

[52] U.S. Cl. ..... 206/268; 206/256; 206/273

[58] Field of Search ..... 206/256, 257, 258, 264, 206/268, 271, 273; 229/160.1

[56] References Cited

U.S. PATENT DOCUMENTS 1,086,725 2/1914 O'Neil .
3,404,770 10/1968 Peery .
5,150,720 9/1992 Focke et al. ..... 206/264

FOREIGN PATENT DOCUMENTS 7826336 12/1978 Germany .
8221855 12/1982 Germany .
8326025 12/1983 Germany .
4005443 8/1991 Germany .
9103702 8/1991 Germany .
4200719 8/1992 Germany .
351028 6/1931 United Kingdom ..... 206/256
596645 1/1948 United Kingdom .
1086725 10/1967 United Kingdom .

*Primary Examiner*—David T. Fidei
*Attorney, Agent, or Firm*—Sughrue, Mion, Zinn, Macpeak & Seas

[57] ABSTRACT

A hinge-lid pack made from thin cardboard with a pack part and a lid connected pivotably to the pack part. A one-piece collar consisting of a collar front wall and collar side tabs is arranged in the pack part. The collar partly projects from the pack part and is surrounded by the lid in the closing position. The collar side tabs extend in the region of the inner sides of the side walls of the pack part. At least a middle part region of the collar front wall is set back with respect to the front wall of the pack part, and is arranged inside of the pack part at a distance from the front wall and parallel to the front wall, so that inside the pack part, two upright chambers are created. At least one article is accommodated in each of the upright chambers, which are separated from one another by the collar front wall, and which extend along the entire height of the pack part.

7 Claims, 4 Drawing Sheets

HINGE-LID PACK

BACKGROUND OF THE INVENTION

1. Field of the Invention

The invention relates to a cuboid pack made from thin cardboard, especially a hinge-lid pack with a pack part and a lid connected pivotably to the latter and with a one-piece collar attached in the pack part and consisting of a collar front wall and collar side tabs, the collar partially projecting out of the pack part and being surrounded by the lid in the closing position.

2. Description of the Related Art

The foregoing hinge-lid pack of typical construction is used to a great extent throughout the world for the packaging of cigarettes (hinge-lid pack). The present invention is concerned with developing hinge-lid packs of this type for other areas of use.

SUMMARY OF THE INVENTION

The object on which the invention is based is, therefore, to design a hinge-lid pack or a pack of comparable construction, in such a way that it is suitable for receiving at least two individual articles, these being separated from one another.

To achieve this object, the pack or hinge-lid pack according to the invention is characterized in that the collar front wall is set back over its entire height relative to a front wall of the pack part, in such a way that two vertical chambers, separated from one another by the collar front wall and each for receiving at least one article, are obtained within the pack part.

Thus, according to the invention, the collar customary in hinge-lid packs performs a double function. It serves, on the one hand, for fixing the lid in the closing position and, on the other hand, for forming a partition wall within the pack or within the pack part.

According to the invention, the collar can be shaped in various ways, in order to perform the foregoing function. At the same time, the collar is always designed and folded in such a way that the collar side tabs extend at least with a part region over the entire width of the pack part or over the entire width of the interior of the pack. The collar can thereby further perform a stabilizing or supporting function within the pack part.

BRIEF DESCRIPTION OF THE DRAWINGS

Further particulars of the invention are explained in more detail below by means of exemplary embodiments of the pack or hinge-lid pack. In the drawing:

Figure 1:
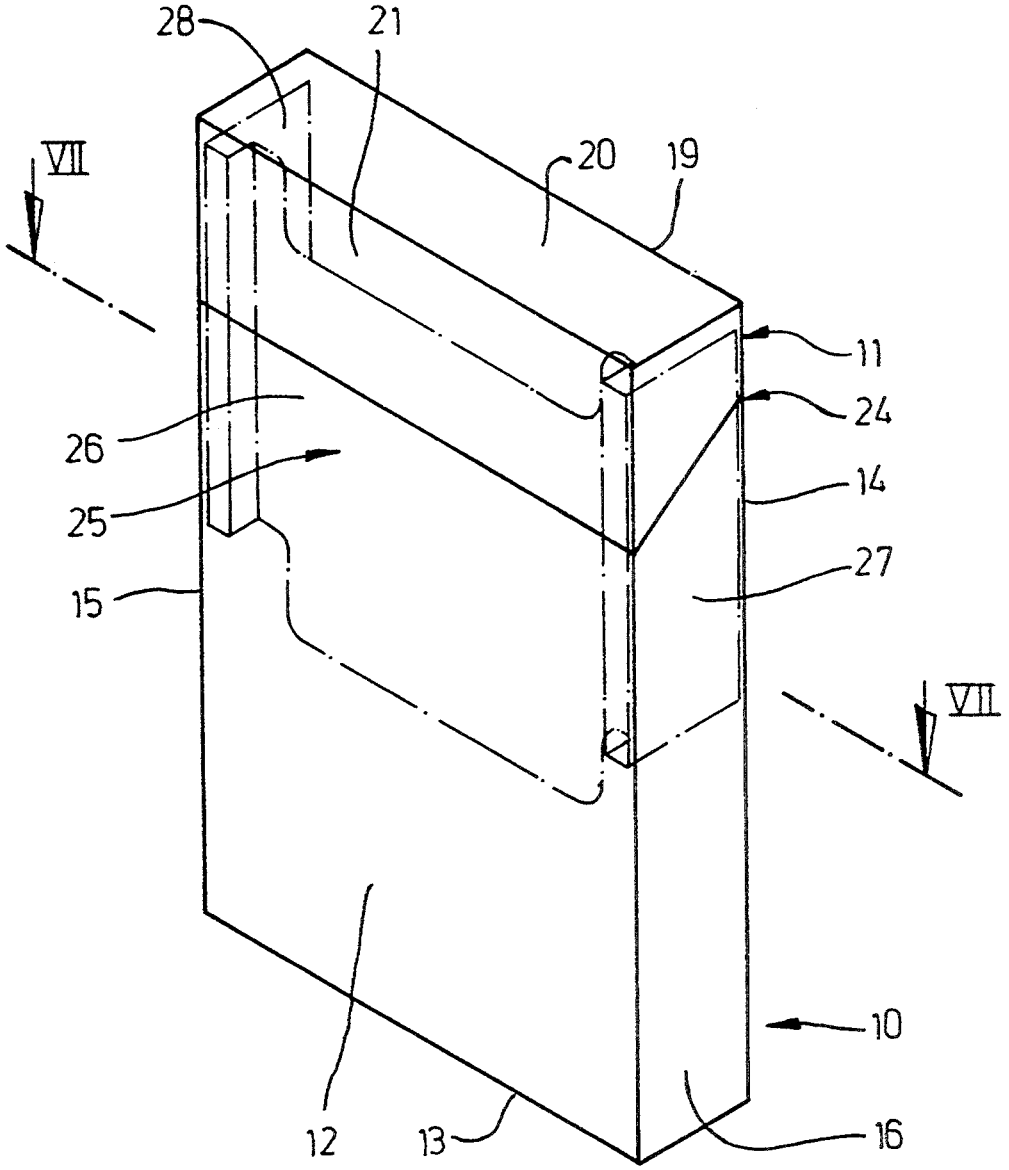
Figure 2:
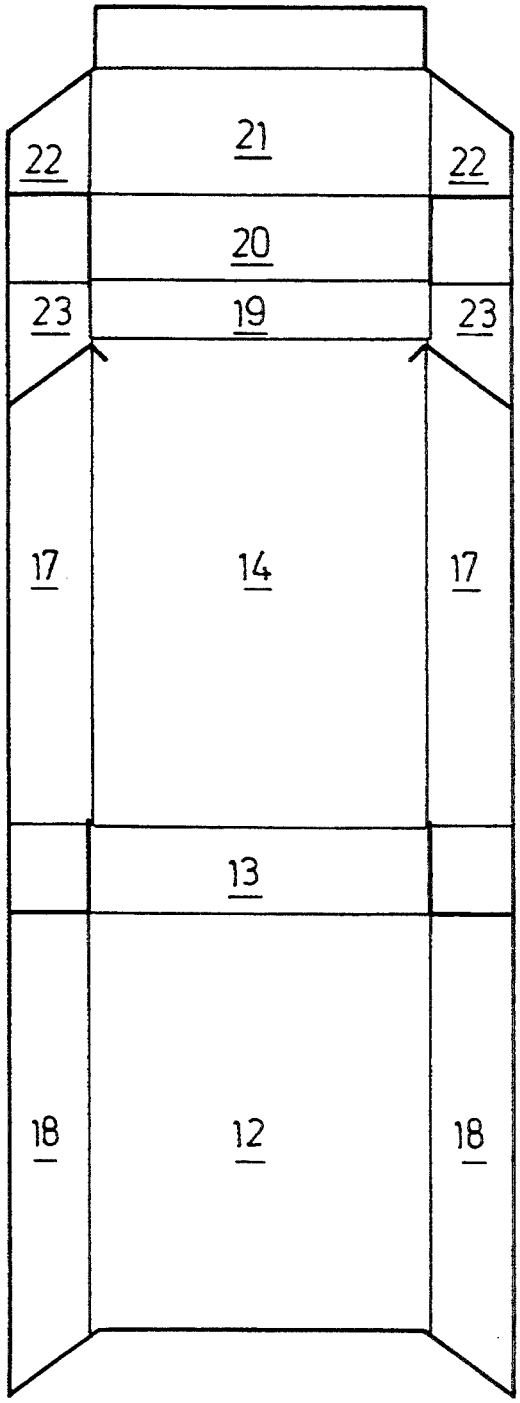
Figure 3A:
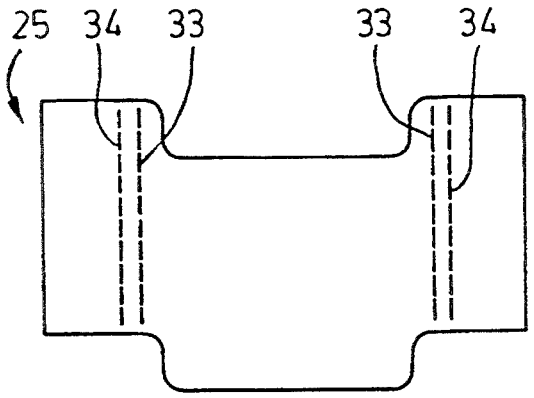
Figure 3B:
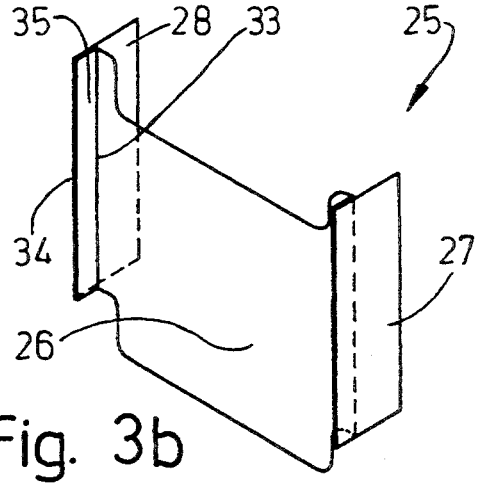
Figure 4A:
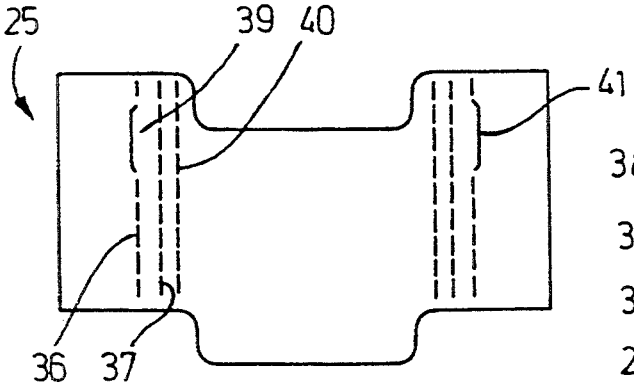
Figure 4B:
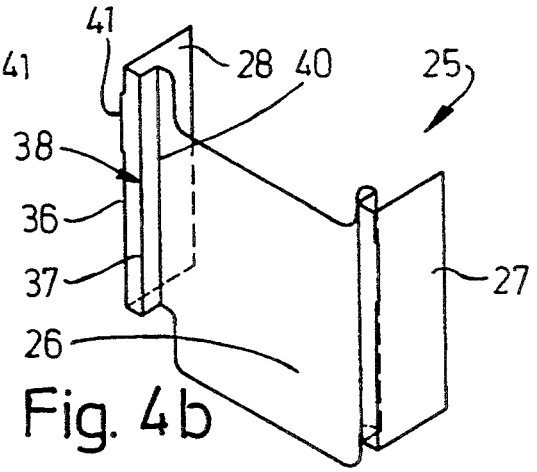
Figure 5A:
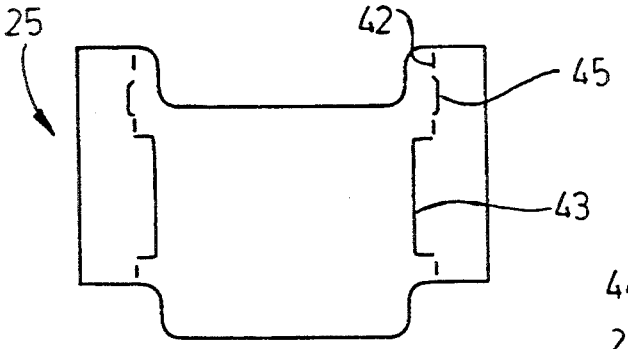
Figure 5B:
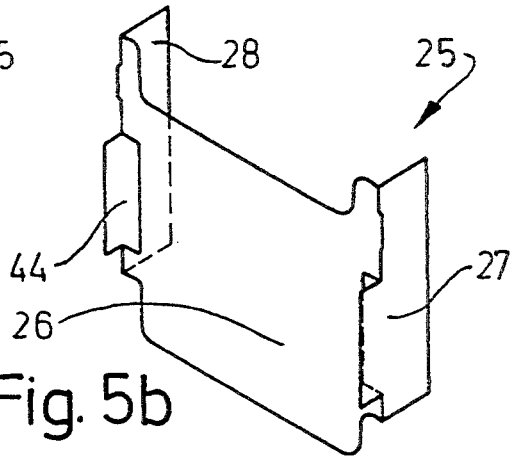
Figure 6:
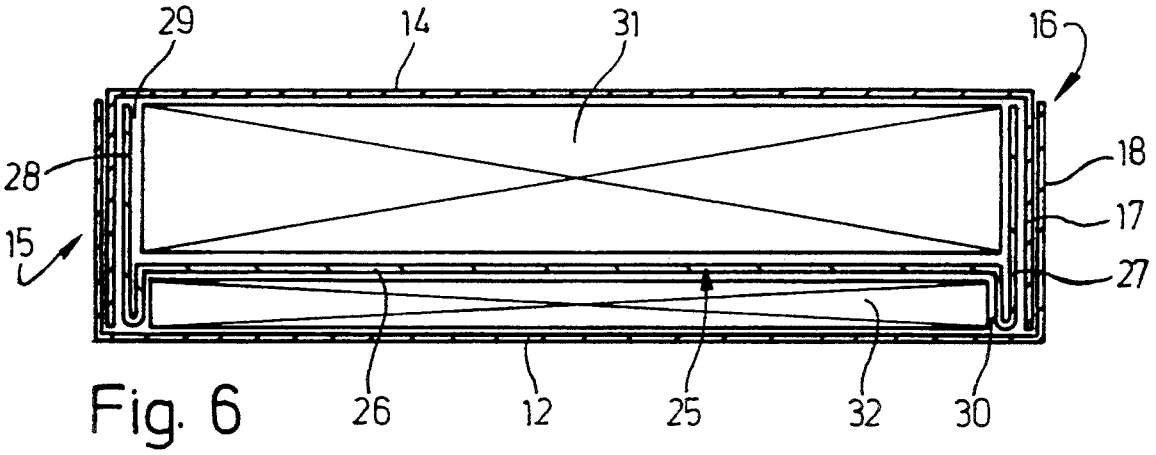
Figure 7:
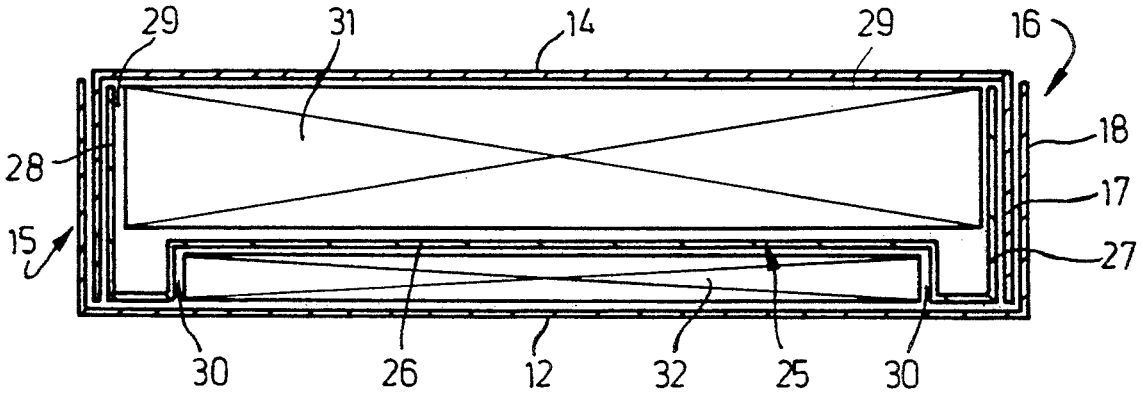
Figure 8:
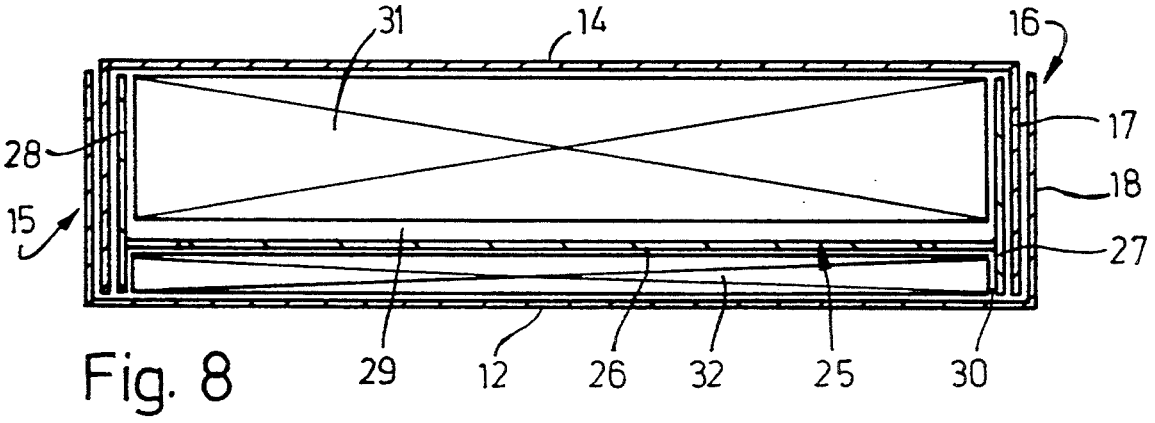

| | |
|---|---|
| FIG. 1 | shows a closed hinge-lid pack in a perspective representation, |
| FIG. 2 | shows a spread-out blank for a hinge-lid pack according to FIG. 1, |
| FIGS. 3a to 5a | show differently designed blanks for a collar in the spread-out position, |
| FIGS. 3b to 5b | show the perspective representations corresponding to FIGS. 3a to 5a, of the folded collars, as a detail of the packs, |
| FIG. 6 | shows a horizontal section through a pack part of a pack according to FIG. 1, with a collar according to FIG. 3a and FIG. 3b, |
| FIG. 7 | shows a horizontal section in the plane VII-VII of FIG. 1, with a collar in the design according to FIG. 4a and FIG. 4b, |
| FIG. 8 | shows a horizontal section through a further exemplary embodiment according to |

-continued

| |
|---|
| FIG. 5a and FIG. 5b. |

DETAILED DESCRIPTION OF THE PREFERRED EMBODIMENTS

The illustrated exemplary embodiments of packs relate to the design of hinge-lid packs made from thin cardboard, if appropriate with coatings, but also from other suitable, namely foldable packaging material. In this basic construction, the hinge-lid pack consists of a (lower) pack part 10 and of a lid 11.

FIG. 2 shows a typical blank for a hinge-lid pack of this kind. The blank and the hinge-lid pack produced from it consequently possess, in the region of the pack part 10, a front wall 12, adjoining the latter a bottom wall 13 and a rear wall 14. Side walls 15 and 16 of the hinge-lid pack or of the pack part 10 each consist of two side tabs 17 and 18 overlapping one another. The side tabs 18 connected to the front wall 12 are located on the outside (FIG. 6 to FIG. 8).

The lid 11 consists of a lid rear wall 19, of a lid top wall 20 and of a lid front wall 21. Lid side tabs 22 and 23 overlapping one another serve for forming lid side walls. The lid 11 is connected to the rear wall 14 of the pack part 10 in the region of the lid rear wall 19 via a joint 24.

Arranged within the hinge-lid pack is a collar 25. This consists of a one-piece blank, likewise made from thin cardboard or another suitable material. The collar 25 forms a collar front wall 26 and collar side tabs 27 and 28. The collar 25 is seated with a lower region in the pack part 10, specifically conventionally in such a way that the collar front wall 26 bears against the inside of the front wall 12 of the pack part and is connected to the said front wall 12. The collar side tabs 27, 28 extend in the region of the side walls 15, 16 on the inside of the latter. The lower region of the collar side tabs 27, 28 therefore bears against the inside of the inner side tabs 17. The collar side tabs 27, 28 can be connected to the side tabs 17 by adhesive bonding in order to increase the stability. An upper region of the collar 25 projecting out of the pack part is surrounded by the lid in the closing position of the hinge-lid pack (FIG. 1).

In the exemplary embodiments illustrated, the collar 25 is, in each case, designed in a special way, namely in such a way that the collar front wall 26 is clearly set back at least predominantly relative to the front wall 12 of the pack part 10 and therefore, in the closing position, also relative to the lid front wall 21. A distance is thereby formed between the front wall 12 and the collar front wall 26. A hinge-lid pack, the interior of which is subdivided into two chambers 29, 30, is obtained as a result.

In the exemplary embodiment shown, the two chambers 29, 30 are of different width or depth. The larger chamber 29 facing the rear wall 14 serves for receiving an article of corresponding dimension. This is primarily a cassette 31, namely a standard music cassette (MC). The smaller chamber 30 serves for receiving a smaller (accessory) article. This is a correspondingly dimensioned leaflet 32 with information on the content of the cassette 31 or on authors, interpreters or composers. As a result of an appropriate shaping of the hinge-lid pack and of the collar 25, the chambers 29 and 30 are dimensioned in such a way that the articles 31 and 32 are received with a fit.

The varying design or folding geometry of the collar 25 results in differently designed hinge-lid packs. In general, the collar is designed with a greater constructive height than in conventional hinge-lid cigarette packs, in order to guarantee a delimitation of the chambers 29, 30 over a sufficient height of the interior of the pack. In contrast to the exemplary embodiments illustrated, the collar 25 can extend at least with the collar front wall 26 as far as the bottom wall 13 of the pack part 10, if a subdivision of the pack part 10 over its entire height is required.

In all the exemplary embodiments, the collar front wall 26 is set back continuously over the entire height relative to the front wall 12. However, the collar side tabs 27, 28 always extend over the entire width of the interior of the pack part 10.

In the exemplary embodiment according to FIGS. 3*a* and 3*b*, the collar front wall 26 is delimited relative to the collar side tabs 27, 28 by two parallel folding lines 33, 34. At the same time, the folding lines 34 define a front edge of the collar side tabs 27, 28 which is defined by a 180° fold. This front edge faces the front wall 12 and bears against the latter. The set-back folding lines 33 parallel thereto form a 90° fold, with the result that the collar front wall 26 is directed transversely relative to the collar side tabs 27, 28. Between the two folding lines 33, 34 is obtained a material strip 35 which leads locally to a double-layered design of the collar side tabs 27, 28 and therefore to an increase in the stability of the collar 25. The width of the material strip 35 at the same time defines the depth of the chamber 30 (FIG. 6).

In the exemplary embodiment of FIG. 4*a* and FIG. 4*b*, which corresponds at the same time to the cross-section according to FIG. 7 and also to the exemplary embodiment of FIG. 1, a fold of U-shaped cross-section is formed in the region of the collar front wall 26. Two parallel folding lines 36 and 37 respectively define 90° folds, so that web-like vertical projections 38 are obtained on both sides of the set-back collar front wall 26. These bear with a material strip 39 against the front wall 12. A further folding line 40 for a 90° fold defines the transition of the projection 38 to the set-back collar front wall 26. The chamber 30 thus formed and delimited on the inside by the collar front wall 26 has a transverse dimension which is smaller by the projections 38.

The advantage of this construction is that the folding line 36 extending between the collar side tabs 27, 28, on the one hand, and the material strip 39, on the other hand, can have a U-shaped punching, known in conventional hinge-lid packs, in order to form a projecting nose 41. This forms a closing aid for the lid 11 in the closed position of the hinge-lid pack.

A simple and material-saving design of the hinge-lid pack or of the collar 25 emerges from FIG. 5*a* and FIG. 5*b* and from the associated sectional representation in FIG. 8. The blank for the collar 25, the said blank being designed with a conventional width or transverse dimension, is provided with a folding line 42 which, by means of a 90° fold, forms an edge of the collar 25 set back relative to the front wall 12. The collar front wall 26 is therefore set back relative to the front wall 12 over the entire width of the pack part 10. The collar side tabs 27, 28 extend only in a part region over the entire (inner) width of the pack part 10. This is achieved by means of a U-shaped punching 43, the legs of which adjoin the folding line 42 interrupted in the region of the U-shaped punching 43. The profile of the U-shaped punching 43 is placed in such a way that the open side faces the collar side tabs 27, 28. A folding of these transversely to the collar front wall 26 forms supporting tabs 44 which, as a result of a corresponding dimension of the U-shaped punching, together with the remaining part of the collar side tabs 27, 28, correspond to the width of the interior of the pack part 10. In the exemplary embodiment shown, the U-shaped punching 43 or the supporting tabs 44 formed from it are located completely within the pack part 10.

The folding edge set back relative to the front wall 12 and obtained as a result of the folding line 40 is provided with a punching in a similar way to the exemplary embodiment of FIG. 4*a* and FIG. 4*b*, in order to form a nose 45. This bears, with a hinge-lid pack closed, against the inside of the lid side walls, specifically at a distance from the lid front wall 21. The noses 45 nonetheless form a closing aid for the lid.

I claim:

1. A hinge-lid pack made from thin cardboard, and having a pack part (10) and a lid (11) connected pivotably to the pack part, wherein:

a) a one-piece collar (25) comprising a collar front wall (26) and collar side tabs (27, 28) is arranged in the pack part (10) so that the collar (25) partly projects from the pack part (10) and is surrounded by the lid (11) in a closing position;

b) the pack part has a pack front wall (12), and two side walls (15, 16) along inner sides of which the collar side tabs (27, 28) extend; and c) at least a middle part region of the collar front wall (26) is set back with respect to the pack front wall (12) of the pack part and is arranged inside of the pack part (10) at a distance from the pack front wall (12) and parallel thereto, so that inside of the pack part (10) two upright chambers (29, 30) are created, each for accommodating at least one article (31, 32), which are separated from one another by the collar front wall (26), one (30) of the upright chambers facing the pack front wall (12) and having a bottom defined by an inner bottom wall of the pack part.

2. A pack according to claim 1, wherein the collar side tabs (27, 28) extend over the entire inner width of the pack part (10) or of side walls (15, 16) of the pack part, and the collar front wall (26) is connected by a material strip (35) to a front edge of the collar side tabs (27, 28) which is formed by a folding line (34).

3. A pack according to claim 1, wherein the collar front wall (26) is connected to the collar side tabs (27, 28) by a U-shaped fold which forms a projection (38), bearing against the front wall (12) of the pack part (10), on both sides of the set-back collar front wall (26), in such a way that said one chamber (30), which faces the pack front wall (12), has a smaller width than the other (29) of said two chambers.

4. A pack according to claim 3, wherein a vertical folding line (36) formed laterally in the region of the projection (38) has an outwardly directed nose (41) as a result of a U-shaped punching, in order to fix the lid (11) in the closing position.

5. A pack according to claim 1, wherein the collar front wall (26) and collar side tabs (27, 28) are delimited from one another by a common vertical folding line (42) which is set back relative to the front wall (12) of the pack part (10), a part region of the collar side tabs (27, 28) extending beyond the folding line (42) and having a width corresponding to the width of the side walls (15, 16).

6. A pack according to claim 5, wherein the collar side tabs (27, 28) have supporting tabs (44) which correspond to the width of the side walls (15, 16) and which are formed by a U-shaped punching (43) between the collar side tabs (27, 28) and collar front wall (26).

7. A pack according to claim 5, wherein the folding line (42) has, as a result of a U-shaped punching, a nose (45) which is directed laterally to form a closing aid for the lid (11).

* * * * *